US006460442B2

(12) United States Patent
Talesky et al.

(10) Patent No.: US 6,460,442 B2
(45) Date of Patent: Oct. 8, 2002

(54) RIP FENCE WITH DUAL LOCKING MECHANISM

(75) Inventors: Mark S. Talesky, Chicago; Kenneth N. Svetlik, Schaumburg; Ezequiel Romo, Chicago, all of IL (US)

(73) Assignee: S-B Power Tool Company, Broadview, IL (US)

( * ) Notice: Subject to any disclaimer, the term of this patent is extended or adjusted under 35 U.S.C. 154(b) by 0 days.

(21) Appl. No.: 10/087,479

(22) Filed: Feb. 28, 2002

(65) Prior Publication Data

US 2002/0088325 A1 Jul. 11, 2002

Related U.S. Application Data

(63) Continuation of application No. 09/328,837, filed on Jun. 9, 1999, now abandoned.

(51) Int. Cl.[7] ..... B26D 7/01

(52) U.S. Cl. ..... 83/438; 83/468.7; 83/477.2; 144/287; 269/318

(58) Field of Search ..... 83/438, 444, 446, 83/522.19, 477.2, 466.7, 467.1; 269/318; 144/287

(56) References Cited

U.S. PATENT DOCUMENTS 2,101,709 A * 12/1937 Hedgpeth ..... 83/438
2,265,335 A * 12/1941 Aumann ..... 144/253.1
2,273,715 A * 2/1942 Lonskey et al. ..... 144/253.1
2,325,082 A * 7/1943 Tautz ..... 83/438
2,521,302 A * 9/1950 Musselman ..... 144/253.1
2,556,548 A * 6/1951 Modderman ..... 144/253.1
2,562,246 A * 7/1951 Van Dam et al. ..... 144/253.1
2,622,637 A * 12/1952 Gustin ..... 144/253.1
2,630,845 A * 3/1953 Eschenburg ..... 144/253.1
2,677,400 A * 5/1954 Gaskell ..... 144/253.1
2,740,437 A * 4/1956 Odlum et al. ..... 144/253.1
2,771,103 A * 11/1956 Odlum et al. ..... 144/253.1
2,806,493 A * 9/1957 Gaskell ..... 144/253.1
2,919,729 A * 1/1960 Edgemond, Jr. et al. . 144/253.1
2,966,179 A * 12/1960 Gaskell ..... 144/253.1
3,011,531 A * 12/1961 Gaskell ..... 144/253.1
4,206,910 A * 6/1980 Biesemeyer ..... 144/253.1
4,658,687 A * 4/1987 Haas et al. ..... 269/238
4,846,036 A * 7/1989 Metzger et al. ..... 83/438
5,181,446 A * 1/1993 Theising ..... 83/438
5,293,802 A * 3/1994 Shiotani et al. ..... 269/318

* cited by examiner

*Primary Examiner*—Allan N. Shoap
*Assistant Examiner*—Stephen Choi
(74) *Attorney, Agent, or Firm*—Gardner Carton & Douglas

(57) ABSTRACT

A rip fence used with a table saw, where the table saw has an upper cutting surface with a front edge surface and a rear edge surface. The rip fence includes a main casing having a front clamping mechanism at the front end and a rear clamping mechanism at the rear end. The front clamping mechanisms has a frame with a handle pivotally connected thereto. A link is connected at one end to the handle and at another end to a cam. An activation plate is also connected the cam and to a clamping plate. The handle rotates between a locked position and a released position thereby moving the link to rotate the cam against the activation plate. The activation plate causes the clamping plate to laterally move between a locked position and a released position relative the front edge surface. The handle also causes the rear clamping mechanism to move between a locked and a released position relative the rear edge surface.

9 Claims, 5 Drawing Sheets

RIP FENCE WITH DUAL LOCKING MECHANISM

CROSS-REFERENCE TO RELATED APPLICATION

This is a continuation of U.S. Ser. No. 09/328,837, filed Jun. 9, 1999, now abandoned.

BACKGROUND OF THE INVENTION

1. Field of the Invention.

The present invention relates to a rip fence for use with a table saw and, in particular, to a rip fence that has a dual locking mechanism for securing the fence in position.

2. Scope of the Prior Art.

Table saws of various designs include a frame and an upper surface having an opening through which a blade extends. The upper surface supports a material, such as wood, as it is pushed towards the blade for cutting. Table saws have traditionally been stand-alone pieces of equipment that are used in workshops. Because most stand-alone table saws are used in large open spaces, the dimensions of the table saw can be large enough to support materials of various sizes for cutting. Tables that are used in workshops are not readily moved from one location to another. At construction sites, it is useful to have a table saw that can be easily moved from one location to another or between different construction sites. Accordingly, smaller and portable table saws have been designed. These table saws use lighter materials and have reduced the dimensions of the frame and the upper surface to reduce the size and weight of the table saw thereby creating the desired portable table saw. The portable table saws also use a separable folding table to hold the table saw at the correct height for operation.

An integral part of most table saws is a movable rip fence. The rip fence is positioned perpendicular to the upper cutting surface and is aligned generally parallel to the position of the blade. Most rip fences are designed to span between the front edge and the rear edge of the upper cutting surface. Moreover, the rip fence can be positioned in any position along the upper surface and is secured in such a position by a locking mechanism. The rip fence is usually secured in a position a given distance away from the blade and can be put on either side of the blade. When the rip fence is secured in a position, the wood can be pushed against the side of the rip fence to slide on the upper surface to be cut by the blade. Thus, accurate and straight cuts can be made.

Rip fences of various different designs are readily known in the prior art. In addition, different methods of securing the rip fence at a given location on the upper surface, including the use of a locking mechanism, are known. One of the primary objectives for the rip fence is for it to be generally parallel to the blade so that the most accurate cuts can be made. It is known that an effective way to make the rip fence parallel with the blade is to force it to be perpendicular to the front and rear edge surfaces of the table saw. Thus, many rip fences use a front clamping mechanism and a rear clamping mechanism. The front clamping mechanism presses against the front edge surface and the rear clamping mechanism presses against the rear edge surface. In this way, the clamping mechanism aligns the rip fence perpendicular to the edge surfaces and parallel to the blade.

It is also helpful to properly align the rip fence if the front and rear clamping mechanism move simultaneously. To achieve this, rip fences typically include a handle which is connected to the front clamping mechanism and a rod that connects between the handle and the rear clamping mechanism. When the handle is in a first and released position, the front locking mechanism is positioned in a released position relative the front edge surface and the rod reduces pressure and allows the rear locking position to move into a released position relative the rear edge surface. When the handle is in a second and locked position, the front locking mechanism is positioned in a locked position along the front edge surface and the rod pushes the rear locking mechanism into the locked position. As the handle moves from the released to the locked position, the front and rear clamping mechanism engage with the front and rear edges at the same time.

Different types of front and rear locking mechanisms are known. Some front locking mechanisms include a cam that is connected to a handle such that when the handle is put into the locked position, the cam is pushed against a surface on the front edge of the table saw to secure the rip fence in position. U.S. Pat. No. 4,846,036 to Metzger, Jr., et al., reveals a handle that moves a spring-biased clamping portion. In the locked position, the clamping portion is biased against a vertical wall in a slot that is proximate the front edge surface of the upper surface. In the released position, the handle overcomes the biased clamping portion so that it is released from the wall thereby allowing the rip fence to move along the upper surface. As the rip fence moves along the upper surface, the clamping portion moves through the slot.

Other rip fences are provided with different mechanisms to move smoothly along the upper surface. As described, slots can be provided along the upper surface of the table saw through which a portion of the rip fence, like a clamping portion, can slide. In addition, tubular rails can be provided on the front and rear sides of the table saw. In those embodiments, the rip fence include a portion that surrounds the tubular rail so that the rip fence can slide into a selected position. Other types of rails can be provided underneath the upper surface. In addition, the rip fence can include hook portions, tabs or other mechanisms that move relative a part of the upper surface or the frame so that the handle can lock the rip fence in a location.

Because of the rip fences' designs, the handles used to lock the rip fence create inefficiencies. Many such handles are quite long so that their rotation provides enough torque to adequately secure the rip fence in a selected position. Those handles often protrude significantly out from the front edge of the saw where the handle can get in the way of efficiently using the table saw. The large handles can also catch on clothing and other items. In order to reduce the size, other rip fences reorient the handle's location on the rip fence. Other prior art methods alter the direction that the handle rotates relative the table saw. Those alternative embodiments are not as easy to use.

SUMMARY OF THE INVENTION

In view of the foregoing, it is an object of the present invention to develop a portable saw that has a rip fence to overcome the deficiencies of the prior art. What is needed is a rip fence that moves between multiple positions on the table saw, that can be secured easily in any such position, and that does not unnecessarily increase the weight or general dimensions of the table saw. It is also desired to have a rip fence that is aligned parallel to the blade when it is locked into position. Moreover, the rip fence should reduce the dimensions of the handle so that it does not protrude significantly in front of the table saw.

The present invention relates to a table saw that includes a rip fence that is slidable relative to the table saw. The table saw used with the rip fence includes a frame portion and upper cutting surface. A blade extends through an opening in the upper surface to cut wood or other material. The upper surface supports the wood as it is pushed on the table saw and cut by the blade. Front and rear edge surfaces extend perpendicularly from the front and rear edges of the upper surface.

The rip fence of the present invention can be used with a table saw that has movable auxiliary table. The auxiliary table can move between a first position adjacent the upper surface and a variable second position separated from the upper surface according to any known methods. One such method includes rails that are secured to the front and rear edge surfaces of the auxiliary table and that slide along brackets on the rear and front edge surfaces of the upper surface.

The rip fence moves between positions relative the upper surface and can be locked in any such position such that the rip fence is parallel to the blade. This arrangement ensures that accurate cuts are made. To move relative the upper surface, the rip fence engages with a slot which is parallel to the front edge surface formed on the upper cutting surface of the table saw or the upper surface of the front rail. The rip fence can also engage with an groove formed in the rear edge surface of the upper cutting surface or the outer edge of the rear rail.

The rip fence extends between the front edge surface and the back edge surface of the upper cutting surface and includes a main casing that is slightly shorter than the span of the entire rip fence. A front clamping mechanism is provided that is connected to the front end of the casing by a frame. A movable handle is pivotally connected at one end of the handle's upper surface to the frame and rotates between a lower locked position and an upper released position. When the handle is in the locked position, the rip fence is held securely in position relative the upper cutting surface so that the rip fence is generally parallel to the blade. When the handle is in the released position, the rip fence can slide relative the upper cutting surface and longitudinally through the slot and groove.

The front clamping mechanism includes a rotatable cam that has a first end and a second end. In addition, a movable link having an upper end and a lower end is provided. The link is pivotally connected at its upper end to a distal end of the handle's upper surface and pivotally connected at the lower end to the first end of the cam. The cam's second end is pivotally connected to the frame. A vertically extending activating plate is partially contained within the frame such that its upper end is in contact with the cam's second end. The lower end of the activation plate extends below the lower edge of the front clamping mechanism. The activation plate can be pivotally connected to the handle frame at a point below the upper end.

The front clamping mechanism also includes a horizontally extending clamping plate that engages with the slot. The clamping plate includes a passage proximate a first end and a flange, or lip, at an opposing second end. The lower end of the activation plate extends through the passage. The lip engages with the slot so that as the rip fence moves along the upper cutting surface the lip slides longitudinally through the passage. The lip moves laterally within the slot between a locked position and a released position. In the locked position, the lip presses against the walls of the slot so that the rip fence does not slide. In the released position, the lip is free of the slot's walls so that the rip fence can slide to a desired position. The clamping plate moves between the locked position and the released position as the handle moves between its locked and released position. As the handle moves between positions, the link rotates the cam and therefore the activation plate. As the activation plate pivots, its lower end laterally moves the clamping plate between the locked and released positions.

The rip fence of the present invention also includes a rear clamping mechanism that has a second activation plate. An upper end of the rear activation plate is pivotally connected to a rear frame. A portion, or tab, is provided at a lower end to engage with the groove provided along the rear edge surface of the table saw. A spring-loaded rod maintains contact between the front activation plate and the upper end of the rear activation plate. The second activation plate, and therefore the portion, move between a locked position and the released position as the handle moves between those positions. As the handle moves between those positions, the first activation plate rotates about its pivot point thereby moving the rod. As the rod moves, it forces the rear activation to rotate about its pivot point so that the tab moves between the locked position and the released position. In the locked position, the edges of the portion engage with the walls of the groove so that the rip fence is secured in a position and is parallel to the blade. In the released position, the portion is removed from the groove so that the rip fence can move along the upper surface.

The front clamping mechanism, or the casing, can include gliding blocks that slide through the slot. The glide blocks are arranged on either side of the clamping plate and permit the rip fence to move smoothly through the slot between various positions. In addition, the rip fence can include a roller assembly that allows the rip fence's rear clamping mechanism to move smoothly.

In view of the foregoing, a rip fence is provided that moves smoothly between various positions along the upper cutting surface. The multiple pivot points in the front clamping mechanism also provide a handle that is easy to use and that does not protrude out from the table saw. The clamping plate and rear activation plate also provide effective mechanisms to secure the rip fence in a position so that the rip fence does not move during operations of the table saw. In addition, the front and rear clamping mechanisms align the rip fence in a generally parallel arrangement with the blade when they are moved into the locked position.

These and numerous other features and advantages of the present invention will become readily apparent from the following description, the accompanying drawings and the appended claims.

DETAILED DESCRIPTION OF THE DRAWINGS

Figure 1:
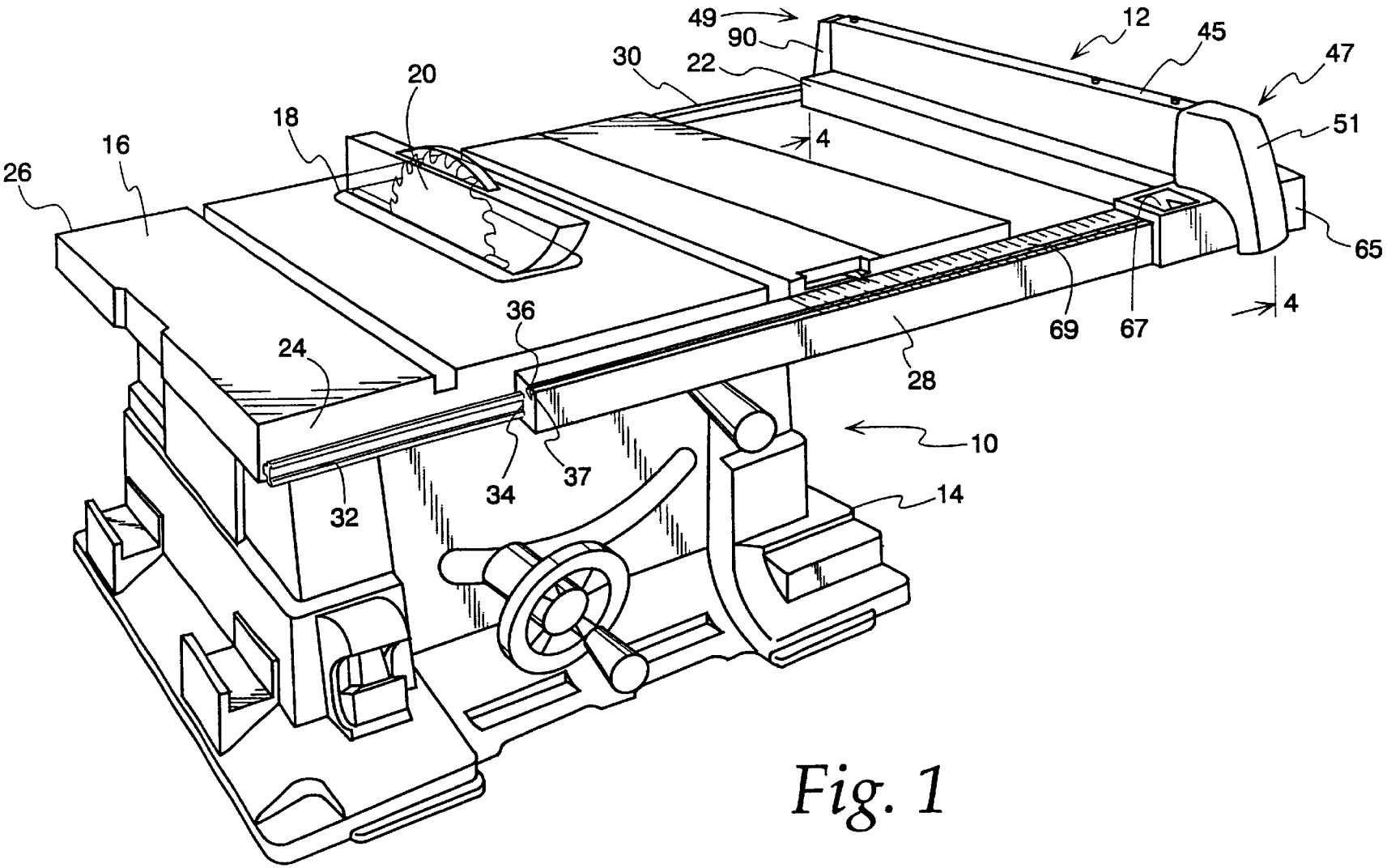
FIG. 1 illustrates a table saw having a rip fence made in accordance with the principles of the present invention.
Figure 2:
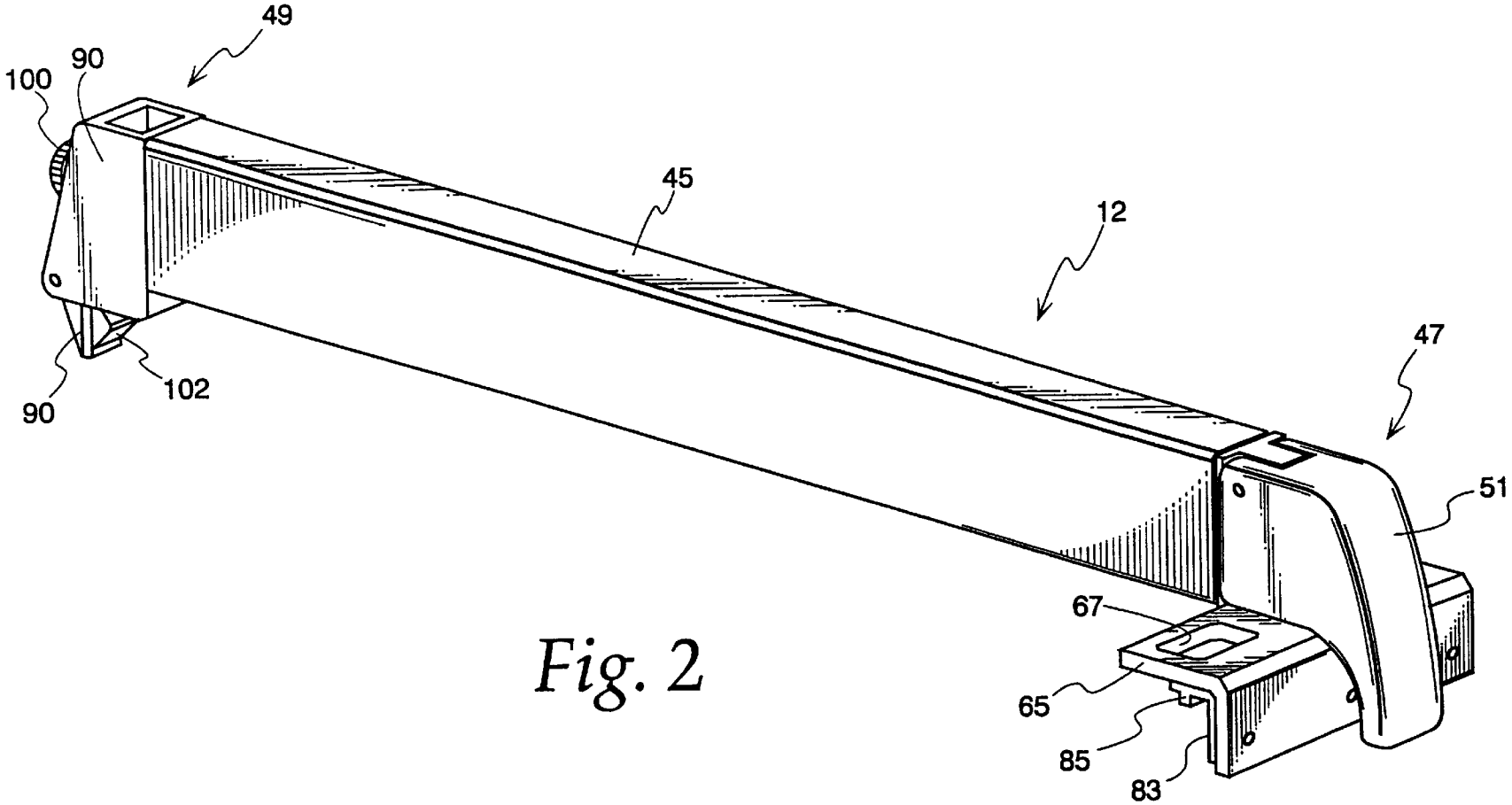
FIG. 2 is a perspective view of the rip fence of the present invention.
Figure 3:
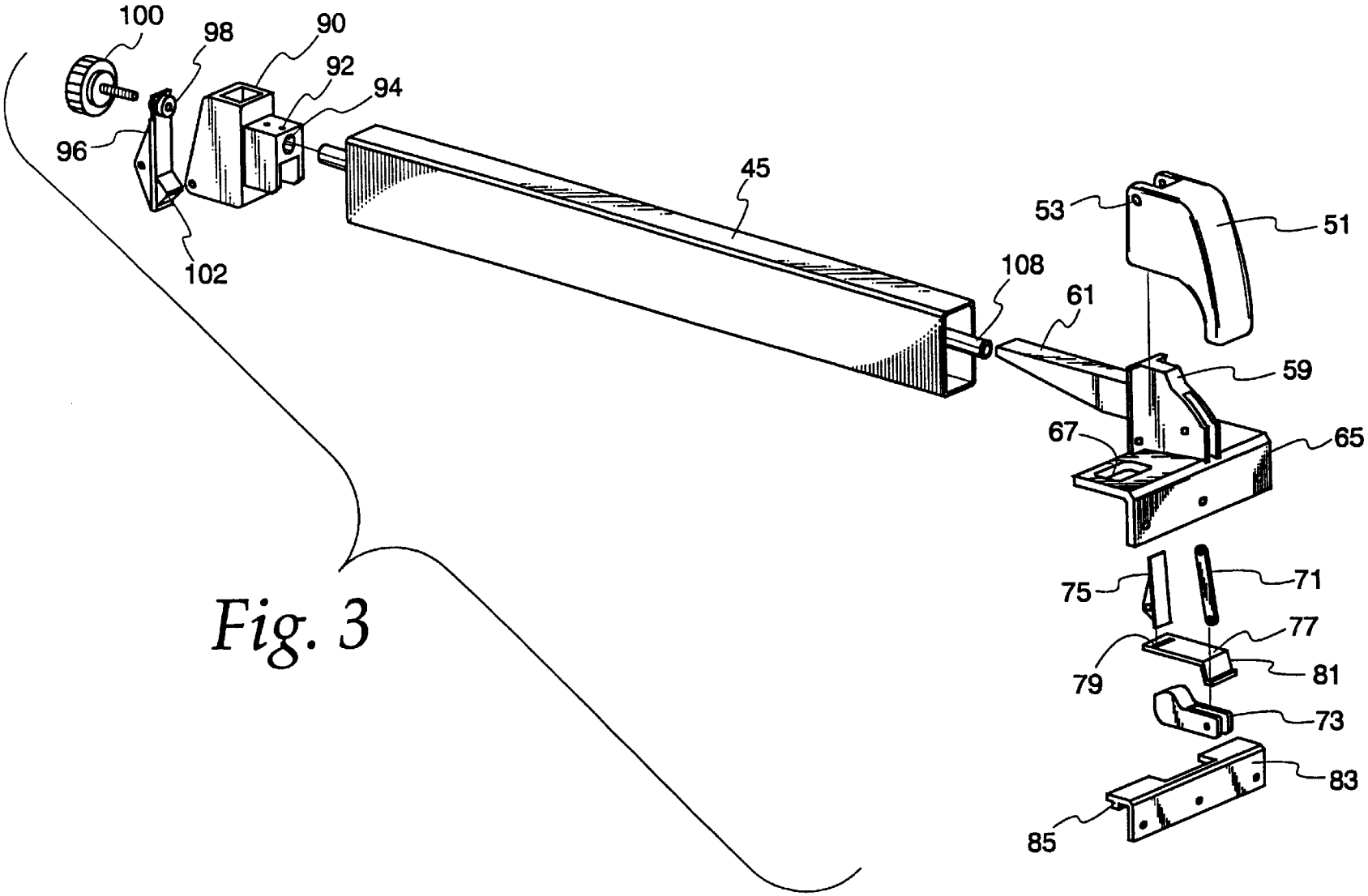
FIG. 3 is an exploded view of the rip fence's components.

DETAILED DESCRIPTION OF THE PREFERRED EMBODIMENT:

FIG. 1 illustrates a table saw 10 having a rip fence 12 made in accordance with the principles of the present invention. The table saw 10 can be of any known type such as a stand-alone table saw or a portable table saw. The table saw shown in FIG. 1 is designed as a professional-use portable table saw that is durable and can also be moved from site to site. The table saw 10 includes a frame 14 and an upper cutting surface 16. The upper cutting surface 16 has an opening 18 through which the blade 20 extends. The blade is used to cut a material, such as wood, that is pushed along the upper cutting surface 16. In the preferred embodiment, as seen in FIG. 1, the table saw includes an auxiliary table 22 that is movable between a position adjacent the upper cutting surface and an extended position separated from the upper cutting surface 16. FIG. 1 shows the auxiliary table 22 in the extended position.

The upper cutting surface 16 includes a front edge surface 24 and a rear edge surface 26 which extend perpendicularly from the upper surface. The auxiliary table 22 of the preferred embodiment has a front rail 28, which is connected to the front edge surface of the auxiliary table, and a rear rail 30, which is connected to the rear edge surface of the auxiliary table. The rails 28, 30 are slidably engaged to the front and rear surfaces 24, 26, respectively, along brackets 32 which are attached to the front and rear edge surfaces 24, 26. As seen in FIG. 1, the rails 28, 30 include a channel 34 in which the brackets 32 pass slideably through the channel 34. In the preferred embodiment, the front rail 28 includes a slot 36 that extends longitudinally along the upper surface of the front rail 28. An upper flange 37 extends from the rail's upper surface over a portion of the slot 36. In an alternative embodiment, the slot 36 can be arranged on other surfaces relative to the front edge surface 24 such as the upper cutting surface 16, the outer edge surface of the rail 28, or the front edge surface 24.

The rip fence 12 is configured to slide on rails along the upper cutting surface 16 and, if necessary, with the auxiliary table 22 and on either side of the blade 20. The rip fence is configured to be in either a locked position, in which the rip fence is aligned generally parallel with the blade, or a released position, in which the rip fence 12 can slide on rails along the upper cutting surface 16 or the auxiliary table 22. Referring to FIGS. 2–7, the rip fence 12 includes a main casing 45, a front clamping mechanism 47 and a rear clamping mechanism 49. The main casing has a generally rectangular tubular form so that two of the outer surfaces are generally perpendicular to the upper cutting surface 16. The front clamping mechanism 47 is attached to the front end of the main casing 45. The rear clamping mechanism 49 is attached to the rear end of the main casing 45.

The front clamping mechanism 47 includes a handle 51 that pivots between a locked lower position and a released upper position, which will be described in further detail below. The handle 51 is pivotally connected to a frame through pivot holes 53 provided on the upper edge 55 of the handle. A cantilevered element 61 extends from an edge of the frame 59 proximate the casing 45. Cantilevered element 61 fits into the main casing 45. The triangular frame 59 is supported on a generally L-shaped plate 65. The plate 65 can include a viewing window 67 through which a scale 69 can be read.

The front clamping mechanism 47 also includes an elongated link 71 that has an upper end and a lower end. As seen in FIGS. 4–7, the upper end of link 71 is pivotally connected to a point towards the upper edge 55 of the handle distal the pivot holes 53. The lower end of link 71 is pivotally connected to a cam 73. The cam 73 has a generally J-shape. The link 71 is pivotally connected to the straight leg of the J-shaped cam 73. The opposing end of link 71 is pivotally connected to the frame 59. The front clamping mechanism 47 also includes a front activation plate 75. The front activation plate 75 is pivotally connected to the frame 59 at a point between the upper and lower ends such that the activation plate's lower end extends below the lower edge of the frame 59.

The rip fence also includes a horizontally extending clamping plate 77. In the preferred embodiment, the clamping plate 77 is made of spring steel or another suitably flexible material. At one end, the clamping plate 77 includes a laterally extending passage 79. At the opposing end, the clamping plate has a generally L-shaped lip, or flange 81. As it is assembled, the front activation plate's lower end extends into the passage 79. As the activation plate 75 pivots within the front clamping mechanism 47, the activation plate moves laterally within the slot 36 between a locked position and a released position.

In the preferred embodiment, the front clamping mechanism 47 also includes a glide plate 83 which is secured to the L-shaped plate 65. The glide plate includes blocks 85 to assist the rip fence 12 as it slides through the slot 36. The glide plate and blocks are preferably made of plastic or another suitable material that will slide smoothly against the front rail 28 and in the slot 36.

The rear clamping mechanism 49 for the rip fence 12 includes a rear frame 90. At one end, the rear frame 90 includes a rectangular portion 92 that fits into the main casing 45. A hole 94 is provided in the rectangular portion which extends through to the other end of the rear frame 90. A rear activation plate 96, having an upper end and a lower end, is pivotally connected towards its lower end proximate the lower edge of the rear frame 90. At the plate's upper end, a hole 98 is provided through which an adjustment screw 100 can be threaded. At the lower end, the rear activation plate 96 includes a portion 102, which is a triangular tab. The tab moves between a locked position and an unlocked position and can engage in a generally triangular groove 104 that is provided in the rear rail 30. Alternatively, the groove 104 can be provided in the rear edge surface 26 of the table saw. A roller element 106 is provided along the lower edge of the rear frame 90. The roller element 106 assists the movement of the rip fence 12 as it slides longitudinally across rear rail 30 attached to surface 26.

The rip fence 12 of the present invention also includes an elongated rod 108. The elongated rod 108 extends through the main casing 45 between the front activation plate 75 and the rear activation plate 96 and adjustment screw 100. The rod 108 is supported towards the front end of the casing 45 by the cantilevered element 61 and towards the rear end of the casing 45 by the rear frame 90. The rod 108 extends through the hole 94 to come into contact with the adjustment screw 100. A spring 110 can be provided on the rod 108 towards the rear frame 90. The spring 110 is biased between the rear frame 90 and a ridge 112 provided on the rod 108 thereby pushing the rod against the front activation plate 75. As seen, the spring 110 is a compression spring.

Referring in particular to FIGS. 4–7, an assembled version of the rip fence 12 of the present invention is shown as it is slidably engaged with the table saw 10. The frame 59 is connected to the front end of main casing 45 such that the cantilevered element 61 is positioned within the internal space provided by the main casing 45. For the front clamping mechanism 47, the handle 51 is pivotally connected to the frame 59 such that the handle's pivot point is proximate the main casing 45. Within the internal portion of handle 51 and the frame 59, the link 71, the cam 73 and the front activation plate 75 are arranged. As described above, the link, cam and front activation plate are pivotally connected, thereby reducing the space needed for the handle to move the clamping plate 77 between a released position and a locked position. Accordingly, the front clamping mechanism has multiple pivot points. As seen in the Figures, the lateral movement of the activation plate is in the space provided directly underneath the handle 51 and frame 59 such that it laterally moves in the same general vertical plane as the handle pivots. The front clamping mechanism 47, including the clamping plate 77, is generally positioned on top of the slot 36 such that the handle 51 extends only slightly in front of the front rail 28.

Figure 6:
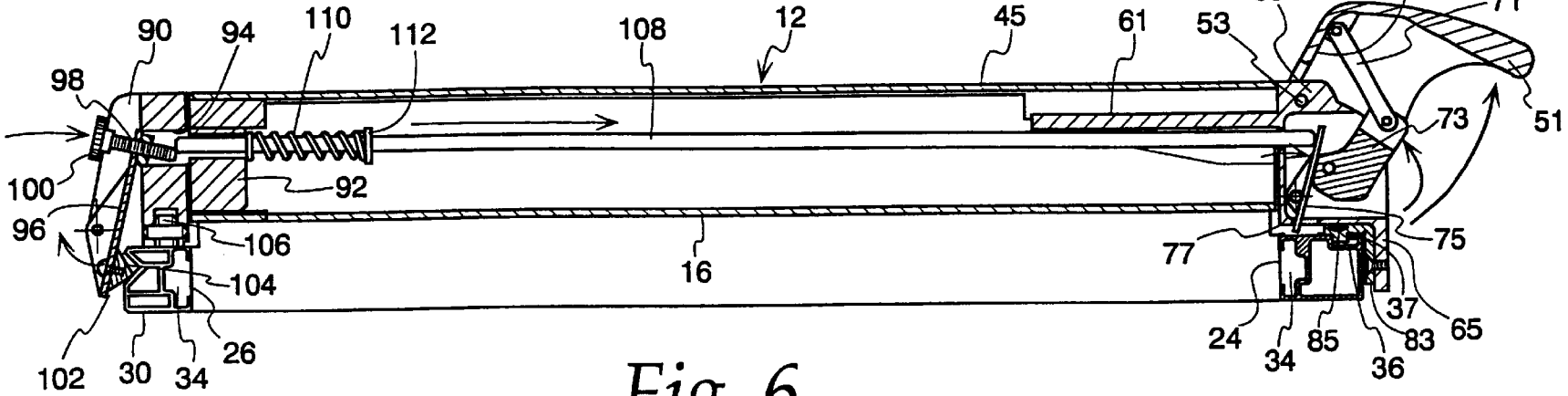
FIG. 6 is a cross-sectional view of the table saw with rip fence shown in FIG. 4 in the release position.
Figure 5:
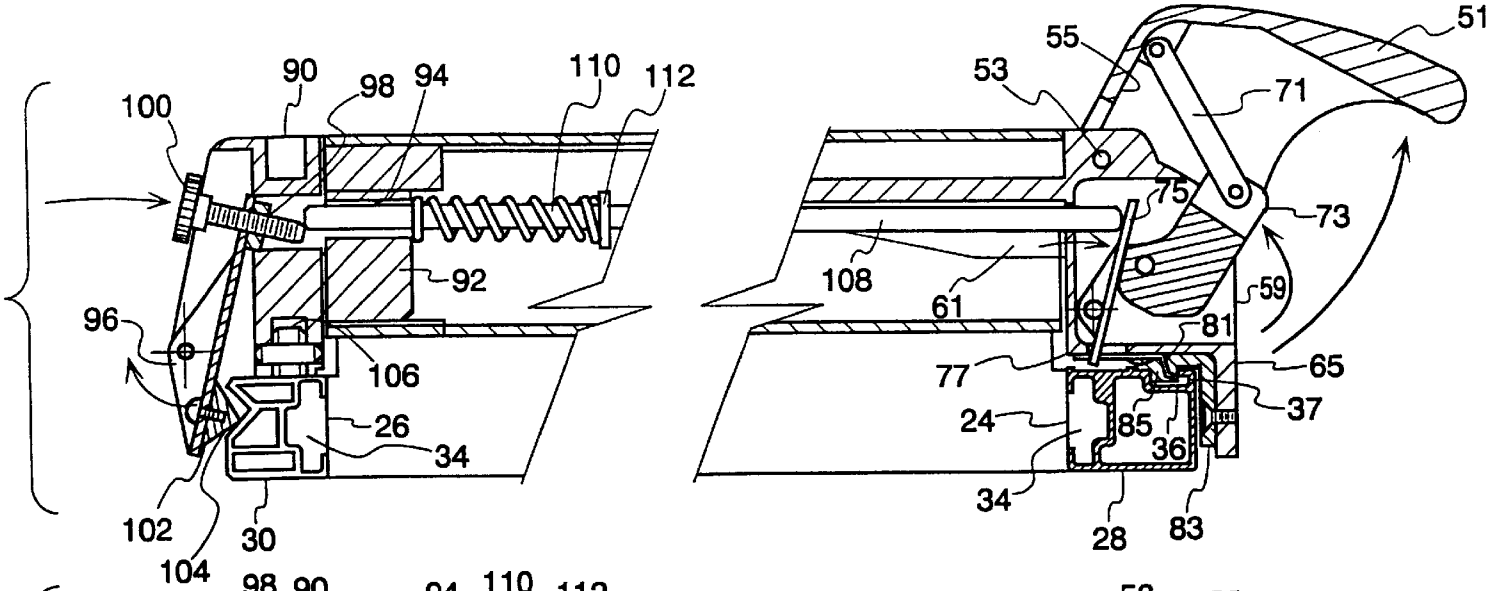
FIG. 5 is an enlarged view of the front and rear ends of the table saw and rip fence shown in FIG. 4.

The rip fence 12 extends laterally across the upper cutting surface 16 between the front edge surface and the rear edge surface. In operation, the rip fence slides longitudinally along the upper cutting surface when the handle 51, the clamping plate 77 and tab 102 are in the released position. The rip fence 12 can be positioned on either side of the blade 20 and operate in accordance with principles of the present invention. In the released position, the handle is in the upper position, as seen in FIGS. 5 and 6. The lip 81 does not engage with the edges of the slot 36 or the flange 37. In addition, the glide blocks 85 easily move through the slot. The tab 102 is also removed from the groove 104. As the lip 81 and the tab 102 are not engaged with the rails 28, 30 the glide plate 83 and roller element 106 allow the rip fence 12 to easily slide longitudinally along the upper cutting surface to any desired location.

Figure 4:
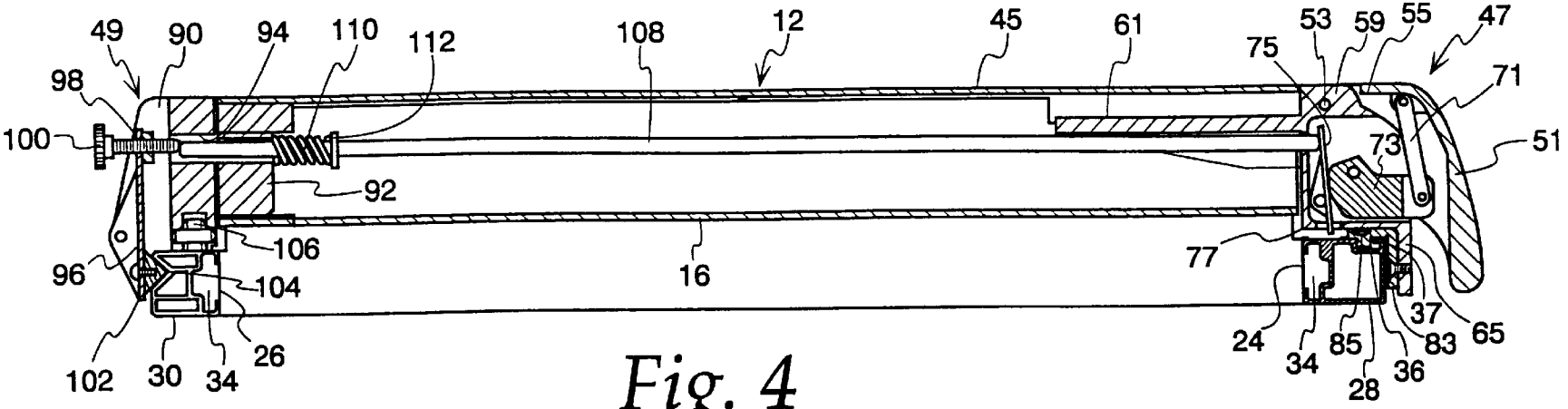
FIG. 4 is a cross-sectional view of the table saw with rip fence in the locked position taken along the lines 4—4 in FIG. 1.
Figure 7:
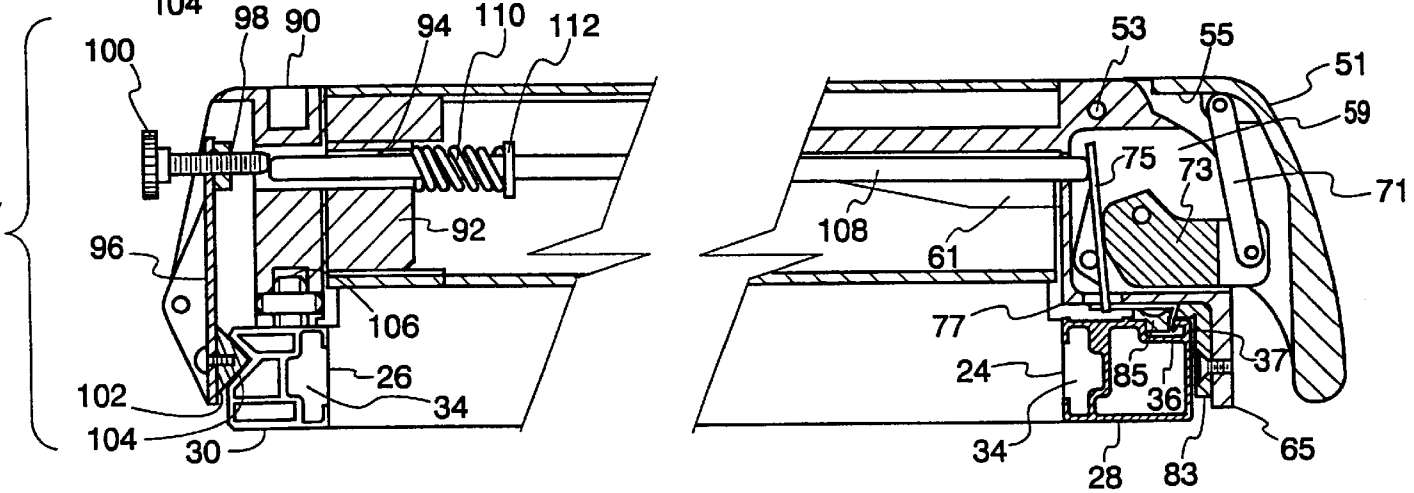
FIG. 7 is an enlarged view of the front and rear end of the table saw and rip fence shown in FIG. 6.

To secure the rip fence in a desired location, the viewing window 67 can be used to select a position along the scale 69. When a desired location is found, the handle 51 can be moved from the released position to the locked position, as shown in FIGS. 4 and 7. In the locked position, the lip 81 is engaged with the walls of slot 36, and the rail 28, and the flange 37, and the tab 102 is engaged with the walls of groove 104. Due to the width of both the clamping plate and the tab, that engagement is sufficient to secure the rip fence 12 in the desired position such that it is generally parallel to the blade 20.

As the handle moves from the released position to the locked position, the handle rotates around the pivot point connected to the frame 59. The rotational movement of the handle 51 pushes the link 71 so that it rotates around its upper end and pushes the cam 73 to rotate about its pivot point on the frame 59. As the cam 73 pivots, it pushes the upper end of the front activation plate 75 towards the rear of the rip fence 12, thereby rotating the front activation plate around its pivot point on the frame 59. The lower end of the activation plate 75, which is connected through the passage 79, causes the clamping plate 77 to laterally move and therefore pushes the lip 81 against the walls of the slot 36, the flange 37 and front rail 28. The clamping plates lateral movement and the shape of the lip provide an effective and improved mechanism to secure the rip fence's position relative the slot 36.

In addition, the rotation of the front activation plate 75 pushes the rod 108 towards the rear clamping mechanism 49. The far end of rod 108 pushes against the activation screw 100 thereby rotating the rear activation plate 96 about its pivot point on the rear frame 90. As the upper end of the rear activation plate 96 is pushed towards the outer end of rear frame 90, the tab 102 is pushed into the groove 104 in rear rail 30. The adjustment screw can be threaded into a suitable position so that tab 102 is properly positioned within the groove 104 when the handle is in the locked position.

As the handle is moved from the locked position into the released position, the handle 51 pivots about its pivot point on the frame 59. The link pulls up on one end of the cam 73 so that the cam pivots about its point on the frame 59. As the cam 73 moves away from the front activation plate 75, the spring 110 pushes the rod against the upper end of the activation plate 75 causing the activation plate to pivot about its pivot point on the triangular frame 59. As the front activation plate 75 moves about its pivot point, it pulls the clamping plate 77 and the lip 81 away from the walls of the slot 36 and the flange 37. The clamping plate is therefore released from the front rail 28. As the rod 108 moves towards the front end of the rip fence 12, the rear activation plate 96 rotates about its pivot point on the rear frame 90 so that the tab 102 moves out of the groove 104. The rip fence is therefore released from the front and rear rails 28, 30 and can slide along the upper cutting surface 16.

Although the present invention has been described in considerable detail with reference to certain preferred versions, other versions are possible. Therefore, the spirit and scope of the appended claims should not be limited to the description of the preferred embodiment described.

What is claimed is:

1. A table saw comprising:

a frame having an upper cutting surface, the upper cutting surface having an opening for a blade to extend through and having a front edge surface and a rear edge surface;

a rail connected to the front edge surface, the rail having a slot extending longitudinally along an upper surface of the rail, and a rip fence slideably engaged to the table saw between various secured positions such that the rip fence is generally parallel to the blade, the rip fence comprising:

an elongated casing extending between a front end proximate the front edge surface and a rear end proximate the rear edge surface;

a handle having an upper edge wherein one end of the upper edge pivots relative the front end of the casing at one end of the upper edge;

a rotatable cam having a first end and a second end;

a movable link pivotally connected at one end to the first end of the cam and an opposing end pivotally connected at an opposing end of the upper edge of the handle;

a first activation plate having an upper end and a lower end, with the lower end engaged towards the second end of the cam;

a clamping plate having a passage formed towards one end and a lip extending from an opposing end, wherein a second end of the first activation plate extending through the passage and the lip being slideably positioned within the rail slot;

an elongated rod movably supported by the casing wherein one end of a rod engages the upper end of the first activation plate;

a second activation plate movably engaged at an upper end to a second end of the rod and wherein the second activation plate has a tab at a lower end, and wherein the handle is movable between a lower locked position such that the link pushes the cam against the upper end of the first activation plate thereby pushing the lip of the clamping plate in a secured position against the rail slot and the first activation plate pushes the rod against the second activation plate so that the tab is in a secured position relative the table saw and an upper released position such that the link pulls the cam away from the upper end of the first activation plate thereby pulling the lip into a released position within the rail slot and the cam pulls the rod away from the second activation plate so that the tab is in a released position relative the table saw.

2. The table saw according to claim 1 wherein the rip fence further comprises glide blocks slidably engaged within the rail slot.

3. The table saw according to claim 1 further comprising a rear rail connected to a rear edge surface of the upper cutting surface wherein the rear rail having a longitudinal extending groove and wherein the tab is movably engaged between a secured position within the groove and a released position away from the groove.

4. A rip fence for use with a table saw, the table saw having an upper cutting surface with a blade extending through an opening therein and having a front and rear edge surface, the rip fence comprising:

a frame portion;

a handle movable between a locked position and a release position, the handle having an inner surface along an upper edge, wherein the handle is pivotally connected to the frame portion to move between the locked and the released positions;

a link movably connected at an upper end to the handle;

a cam connected at a first end to a lower end of the link;

a front activation plate having a first end and an opposing end, wherein the first end is connected to a second end of the cam such that the link, the cam, and the first end of the front activation plate are contained by the frame; and a front clamping plate, having a passage formed towards one end and a lip extending from an opposing end, the front activation plate engaging the passage such that the lip from the opposing end is movably engaged relative the front edge surface of the table saw between a locked position wherein the clamping plate secures the rip fence in a position parallel to the blade and a released position wherein the clamping plate permits the rip fence to slide relative the upper surface and wherein the movement of the handle between the locked and open position moves the link, the cam and the front activation plate to move the front clamping plate between the locked and released positions.

5. The rip fence according to claim 4 further comprising an elongated casing having a front end and a rear end, the frame portion being connected to the front end of the elongated casing.

6. The rip fence according to claim 4 wherein the frame further comprising a glide portion that slideably moves relative the front edge surface of the table saw.

7. The rip fence according to claim 4 further comprising a rear activation plate movable between a locked position when the handle is in the locked position and a released position when the handle is in the open position, the rear activation plate having a tab at the lower end thereof movable relative the rear edge surface thereby securing the rip fence in a position parallel to the blade when the handle is in the locked position.

8. The rip fence according to claim 7 further comprising a rod connected between the front activation plate and the rear activation plate to move the rear activation between the locked position and the released position.

9. The rip fence according to claim 7 wherein the tab fits in a groove formed in the rear edge surface of the table saw.

* * * * *